US005316641A

United States Patent [19]

Wright et al.

[11] Patent Number: 5,316,641

[45] Date of Patent: May 31, 1994

[54] STORAGE TANK INTERNAL CORROSION PREVENTION ANODE APPARATUS AND METHOD

[75] Inventors: Robert L. Wright, 3415 Custer Rd., Suite 130, Plano, Tex. 75023; Tom C. Norman; Timothy C. Norman, both of Athens, Tex.

[73] Assignee: Robert L. Wright, Plano, Tex.

[21] Appl. No.: 991,243

[22] Filed: Dec. 16, 1992

[51] Int. Cl.[5] ..... C23F 13/00

[52] U.S. Cl. ..... 204/197; 204/198

[58] Field of Search ..... 204/196, 197, 147, 148

[56] References Cited

U.S. PATENT DOCUMENTS

| | | | |
|---|---|---|---|
| 1,512,557 | 10/1924 | Mills | 204/197 |
| 2,619,455 | 11/1952 | Harris et al. | 204/197 |
| 2,666,027 | 1/1954 | Vallett | 204/197 |
| 2,941,935 | 6/1960 | Miller et al. | 204/196 |
| 2,996,445 | 8/1961 | Eisenberg et al. | 204/196 |
| 3,196,101 | 7/1965 | Hosford | 204/197 |
| 3,855,102 | 12/1974 | Palmer | 204/147 |
| 3,867,274 | 2/1975 | Herman | 204/197 |
| 4,171,254 | 10/1979 | Koenecke | 204/197 |
| 4,397,726 | 8/1983 | Schwert | 204/197 |
| 4,773,977 | 9/1988 | Houle | 204/197 |
| 4,786,383 | 11/1988 | Houle | 204/148 |

*Primary Examiner*—John Niebling
*Assistant Examiner*—Kishor Mayekar
*Attorney, Agent, or Firm*—John W. Montgomery

[57] ABSTRACT

An internal corrosion prevention anode device and method for retrofitting an existing fuel storage tank of the type having one or more low points, includes inserting an anode through an opening formed in the top of the tank. The anode is formed having a rounded shape so that it will roll to a low point in the storage tank. An elongated electrical conductor is attached to the anode, which conductor has a sufficient length for extending from the top to the bottom of the inside of the tank and has sufficient flexibility to permit the anode to roll to a low point in the tank. A cap closes the opening in the top of the tank and electrically connects the elongated conductor from the anode to the top of the storage tank.

19 Claims, 3 Drawing Sheets

STORAGE TANK INTERNAL CORROSION PREVENTION ANODE APPARATUS AND METHOD

TECHNICAL FIELD OF THE INVENTION

The present invention relates to corrosion protection for liquid storage tanks, particularly to internal anode protection for fuel and oil storage tanks made of steel, such as those located underground at gasoline stations, and more particularly, to an anode and electrical potential circuit which can be inserted and operationally connected without taking a liquid hydrocarbon storage tank out of service.

BACKGROUND OF THE INVENTION

Methods of external corrosion prevention for a storage tank are known which include substantially complete systems of protection, such as one known as the Steel Tank Institute Protection 3 (STIP 3), which includes coating the outside of the tank with fiberglass, positioning anodes around the outside of the tank connected to supply an electrical potential onto the tank, and providing non-conducting bushings at each pipe and pump connection. Anode protection of the outside of a tank does not affect the internal corrosion. Presently, unless a tank is constructed initially with an internal anode protection system or an expensive tank lining, no good internal corrosion protection system is available.

The problem of internal tank corrosion primarily results from the collection of water or moisture inside of the tank, either from contaminated fuel or oil or from condensation from vented air. In fuel or oil, the water is heavier and collects at the bottom of a steel storage tank. The water typically forms an acid when in contact with liquid hydrocarbons for an extended period of time. Complete and total drainage of the water on a regular basis is not a convenient process and is not undertaken with sufficient frequency to avoid the corrosion. Even small amounts of water can result in an acidic solution which begins a corrosion process. The corrosion process is, in effect, an exchange of electrically charged ions between the steel tank and the acidic liquid. The removal of these ions from the steel into the acidic solution is the corrosion process which may lead to tank cracks and leakage.

In order to prevent this type of corrosion, some storage tanks have in the past been constructed initially with anodes made of zinc or magnesium or the like, inside the tank. During construction, the anodes are positioned at the expected lowest point or points in the tank. The anodes are mounted on steel brackets which space the anode slightly above the low point in the tank and provide a completed electrical circuit across the space between the tank and the anode and then through the welded steel bracket back to the anode. Typically, the zinc or magnesium is molded or cast as a block or cylinder onto the horizontal section of an inverted "U" shaped steel bar or bracket.

In the past, some oil storage tanks were formed with a large open top. Methods of and apparatus for protecting the inside of a metal tank against corrosion were devised as disclosed in U.S. Pat. No. 1,512,557, which included placement of anodes in the tank substantially evenly spaced across the bottom and connected with an electrically conductive cable to a portion of the tank preferably above the level of the liquid. Substantially flat plates of zinc or other metal which is electropositive toward iron was used. The metal anode was spaced apart from the bottom of the tank with electrically insulating materials, such as glass, porcelain, bakelite, or the like, either secured directly to the zinc plate or secured to wooden frames supporting the anode plates. A protective coverings of canvas over the top of the plates was also disclosed in U.S. Pat. No. 1,512,557 in order to prevent the deposit of bottom sediments or products of corrosion upon the plates and on the bottom of the tank. The canvas permitted the passage of electrical current to the plate but shielded the top of the plates from sedimentation. This method and apparatus of anode protection was beneficial for open top tanks in which positioning and placement of the flat plate anodes from above was unobstructed. The flat anodes could be appropriately positioned right-side up. The insulative spacers projected only from one side of the plate. The use of this system is not adequate for closed top tanks, such as underground storage tanks. Available access openings are of limited size and do not accommodate bulky flat plate anodes. Positioning of the flat plate anode assemblies, both right-side up and in a desired location, could not be conveniently accomplished through small openings.

Underground storage tanks, such as gasoline tanks and the like, are now commonplace and their use is much more widespread than open mouth tanks of the past. The closure of the top of the tank has reduced the speed with which water accumulates and has reduced concerns regarding sedimentation. However, the problem of internal corrosion continues to exist and there are many existing tanks which were initially constructed without adequate internal anode protection.

Various anodes have been constructed for their use in water tanks, boilers, water heaters and the like, including those which are enclosed during boiler construction as disclosed in U.S. Pat. No. 635,468. Also, various water tank anodes have been designed to be inserted into previously erected tanks or receptacles, in particular those in which a small clearance distance may exist between the tank opening and adjacent structures or other equipment. One such anode is disclosed in U.S. Pat. No. 2,619,455 which provides an anode which is formed with segments on a bendable rod. Another water tank anode design is disclosed in U.S. Pat. No. 2,666,027 which provides a series of anodes interconnected with a spring connector to avoid breakage of the connecting rod due to bending during insertion. The anodes are suspended from the opening in the water. Proximity to the tank bottom is not a factor in water tanks.

Other anodes have been designed for hot water tanks and the like, which are designed to be threadedly received within an opening, such as an outlet port, and rigidly project from the opening into the water tank. Such threaded anodes are disclosed in U.S. Pat. Nos. 3,867,274; 4,773,977 and 4,786,383. These constructions are designed primarily to be inserted through openings at the bottom of the water heater and apparently project a short distance into the tank. Such devices are not adequate for purposes of large fuel and oil storage tanks with top openings, such as those at gasoline pumping stations.

Coating of the interior of the tank with an insulative epoxy or resin or fiberglass or the like, may reduce corrosion and may facilitate effectiveness of an anode.

One such process is disclosed in U.S. Pat. No. 2,941,935 for a tanker ship, where access is presumably more convenient than for an underground storage tank. However, it still requires removing the tanker from operation for a period of time while the coating is applied and the anode is affixed.

Certain anode materials, such as magnesium and aluminum, can produce a hot spark upon metal-to-metal contact with steel, such as by dropping from relatively short distances of several feet Anodes with flexible plastic shielding have been used, particularly in connection with oil transporting trucks or oil tanker ships, which are periodically drained, accessed by workmen for inspections and repairs and thereby exposed to hazards from dropping or contact with other falling metal objects, as disclosed in U.S. Pat. No. 4,171,254. Such anodes are designed to be affixed to the bottom or the walls during construction or while the tank is emptied for inspection or repair. They are not easily adapted for retro-fitting, as by insertion into existing underground fuel storage tanks while they are in operation.

Many underground or closed tanks now in operation have been constructed without internal anodes. To date, there has not been an adequate or convenient way to insert anodes into existing tanks without going through a complicated process which involves taking the tanks out of service. Previously, the tanks had to be drained, cleaned and de-gassed. Then, an opening had to be formed in them of sufficient size for a man to climb inside to either weld anodes supported from the tank at the appropriate bottom locations or alternatively, to completely coat the inside of the tank with a fiberglass or other non-corroding polymeric material. Complete and thorough coating of the interior of the tank has been a difficult process which essentially requires forming an internal fiberglass tank within the existing steel tank. This has been an expensive process and unless properly done to insure complete and total coverage could, in fact, exacerbate the problem. Where portions of the tank were coated and other portions were exposed, a focal point for corrosive activity was formed. In either event, the man-size opening had to be re-sealed as by welding before putting the tank back into service.

SUMMARY OF THE INVENTION

The present invention overcomes the drawbacks of the prior methods of internal corrosion prevention by providing an insertable anode with an electrical circuit connection which can be inserted from the exterior of the tank while the tank continues in service. The storage tank need not even be drained in order to retrofit the anode corrosion prevention device. The anodes are inserted into the tank through an opening in the top which may typically be through an existing bunghole opening. A removable guide may be used to push the position the anodes toward the low spot in the tank. A steel cable, such as a steel wire, is connected between the anode at the bottom of the tank and the top of the tank. Conveniently, the wire is connected with a specially constructed bunghole plug which both closes the existing tank opening and electrically connects the wire from the anode to the steel tank. An electrical potential is developed in the circuit between the anode and the tank for electrical flow. This electrical potential acts to move ions from the anode to the steel tank so that deteriorating corrosion which results from ions moving from the tank to the anode, which would result from ions moving from the tank into collected moisture, is prevented. Further, even where the moisture forms an acidic solution which acts to increase the corrosive ion movement condition, the electrical potential between the dissimilar material, the anode and the tank, counteracts the corrosiveness of the acid.

Another aspect of the inventive insertable anode is that it is supported or spaced apart from the tank surface. The spacing avoids a short circuit directly from the anode to the tank, which may reduce its effectiveness. The electrical connection to complete the circuit is through the wire or cable which connects to the top of the tank.

Another aspect of the invention is that the anodes are formed of cylindrical materials, such that they roll toward the low point in the tank. The wire or cable is sufficiently flexible to allow for this rolling action. Further, so that even small amounts of collected water or electrolytic acid which may be at a depth less than the space between the anode and the tank can be prevented through the use of a unique porous ceramic material which acts as a wick for the electrolyte liquid. Thus, the anodic action occurs through the "wick" ring, even where only a small amount of electrolyte liquid collects, which small amount of electrolyte liquid might not otherwise fill the gap between the anode and the steel tank.

Another aspect of the invention is that the anodes are formed or cast in the form of cylinders within a cylindrical casing of a porous ceramic material. The casing of ceramic material simultaneously acts as a wick for the electrolyte liquid, such that the anodic protection occurs through the wick-like casing, even when only small amounts of acid or salt solution collect at the bottom of the tank. The ceramic material supports the anode spaced apart from the surface of the tank. The cylindrical shape of the porous ceramic material continues to allow the anode to roll to the low spot in the tank. Further, the ceramic material acts to shield the anode from contact with other metal objects, thereby avoiding the type of hot sparks known as thremit, such as a hot spark or a thremit reaction.

Another aspect of the invention is that multiple anodes can be inserted and connected through multiple wires so that each end of the tank which might be lower than another end is provided with the anode. Thus, tanks which may exist in a non-level condition, leaning toward one end or the other, can be successfully retrofit with the anodic protection even where the tilt direction cannot be immediately determined.

Another aspect of the invention is that the anodes can be inserted into tanks even without existing available bunghole openings. All storage tanks typically have at least one fill tube opening. The fill tube opening is removed, a lower jaw of a C-frame punch is inserted into the tank, and a pointed punch pierces through the tank adjacent the fill tube opening. The anodes and wire cables are inserted and positioned through the punched hole. The punched opening is then threaded and closed with a self-threading cap to which the wire cables ends are attached.

BRIEF DESCRIPTION OF THE DRAWINGS

These and other advantages and benefits of the inventive anode system, apparatus and method will be more fully understood with reference to the following detailed description, claims and drawings, in which like elements are represented by like numbers and in which:

DETAILED DESCRIPTION OF THE DRAWINGS

Figure 1:
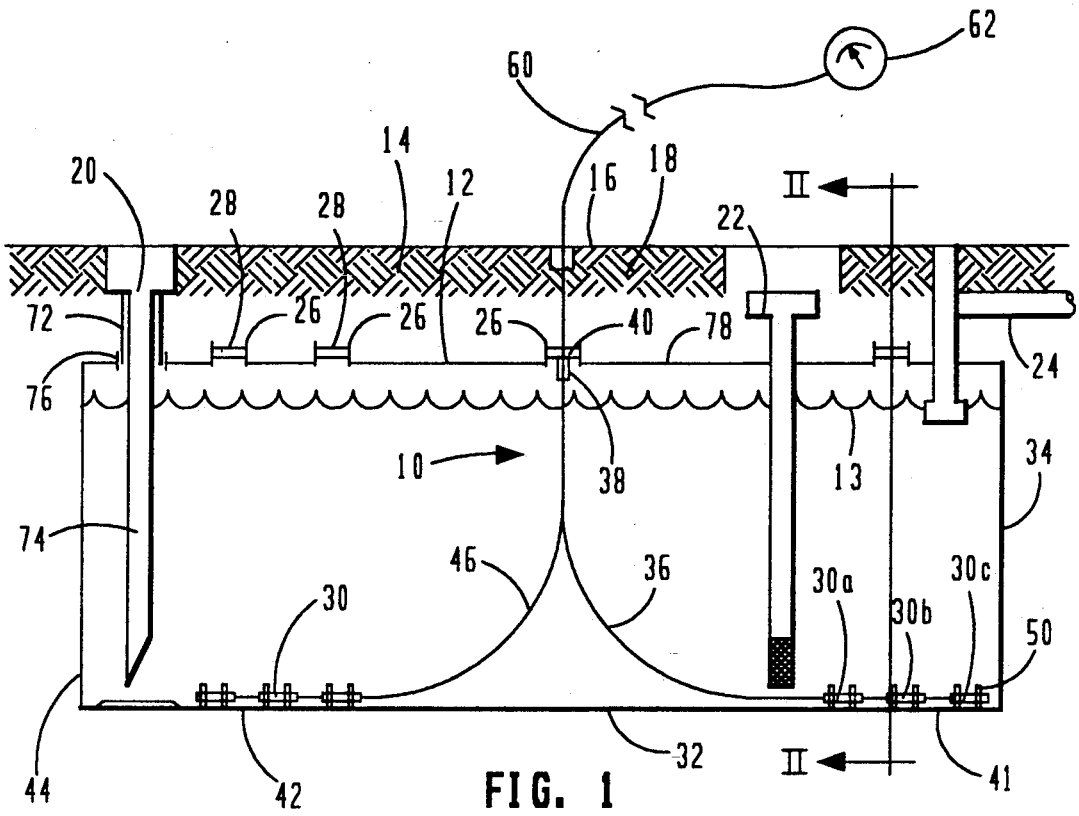
FIG. 1 is a front cut-away schematic view of a typical installation of an internal corrosion prevention device according to the present invention in an underground storage tank.

FIG. 1 schematically depicts an internal corrosion prevention device 10 which has been installed in a typical storage tank 12. Storage tank 12 is of the type for storing liquid and particularly, the type for storing liquid hydrocarbons. Storage tank 12, as depicted, is an underground storage tank having a ground covering 14 below ground surface 16. It will be understood that aboveground storage tanks may also benefit from and be advantageously retrofit with the internal corrosion prevention device according to the present invention. In a typical installation, such as gas station having underground fuel or gasoline tanks, a portion of the ground covering 14 at surface 16 will be concrete slab 18, such as the concrete driveway in a standard gasoline filling station.

The storage tank 12 typically is of the type having a fill tube 20 and a pump tube 22, by which the liquid is pumped from the storage tank. A vent 24 is usually provided to allow any liquid pumped out to be replaced with a gaseous fluid, such as air, and conversely, when the tank is filled or liquid is added through fill tube 20, then a gaseous fluid or air may safely exit through vent 24. Many storage tanks are constructed with one or more bungholes 26 which are capped with bunghole plugs 28. After all necessary access is provided into the tank through the bungholes, such as for the fill tube 20, the submersible pump 22 and the vent 24, additional capped bungholes may remain. For example, an excess number of bungholes are sometimes provided in typical storage tanks to allow alternative positioning of the various attachments according to the needs of a particular installation. With this type of tank, an access hole for insertion of an anode 30, according to the present invention, is easily made by removing an existing bunghole cap. As will be discussed more fully with reference to FIG. 6 below, an access hole can also be formed where there are no available unused bunghole openings.

An inventive anode 30 is inserted at the bottom 32 of tank 12. Preferably, anode 30 is located at the lowest portion of tank bottom 32. This will typically be at one end 34 of tank 12. The metallic portion 31 of anode 30 is typically constructed of zinc or magnesium or another consumable metal which has a positive electromotive potential relative to the material of the tank. Storage tanks are typically made of steel, such that zinc or magnesium provides a desired electrical potential difference between the steel tank and the anode. The anode is connected to the tank with an electrically conducting wire 36, such as a steel wire or cable which connects to the tank at a location preferably separated from the anodes. Advantageously, a steel wire 36 connects to a steel tank without creating a galvanic coupling at the connection point. Wire 36 connects at the top of the tank above the liquid level 13 while the anode 30 is positioned at the bottom of the tank below the liquid level 13. The size of the anode is sufficiently small to insert it through the bunghole 26. The useful life of the anode depends, in part, upon the volume of metal. Anode 30 may comprise a series of anodes **30*a*, 30*b* and 30*c*, all of which are connected via cable 36 to tank 12. This advantageously increases the total volume of the anode while maintaining a small enough size to insert easily through a small access hole. Connecting wire 36 is attached as at a grounding connector 38. Connector 38, for example, may be connected to or integrally formed with special connector bunghole cap 40. While a direct threaded connection is preferred, the connector 38 may be alternatively connected to tank 12** by other means, such as, for example, by using electrically conducting adhesive or metallic glue, or by using a magnetic coupling.

Figure 2:
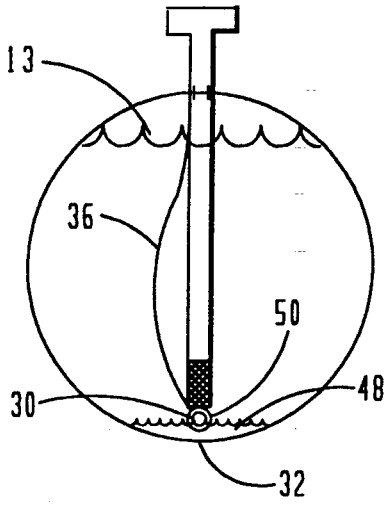
FIG. 2 is a cross-sectional side view of the internal corrosion prevention device installation of FIG. 1 taken along section line II—II.

In a cylindrical shaped tank 12, as depicted in FIGS. 1 and 2, the lowest portion of tank 12 may be toward end 34, or alternatively, toward end 44, depending upon the placement of the tank during its initial installation. Moisture accumulations 48, which have a higher specific gravity than a liquid hydrocarbon 13 which is stored within the tank, will move by the force of gravity to the lowest point along bottom 32. As it is not always known which is the lowest end of the tank, both ends are preferably provided with anode protection. Thus, anode 30 is positioned toward end 34 to find localized low spot 41 and another anode 30 is preferably inserted toward tank end 44 to find another localized low spot 42 and attached to tank 12 through another connecting wire 46. Any moisture which forms a corrosive electrolyte solution 48 will collect at the lowest spot along the bottom of the tank either at end 34, end 44, or both, if the tank 12 is level, and will be provided with anodic protection. The construction of anode 30 is preferably identical at each localized low spot, except for its position. The invention includes a plurality of anodes 30 at a plurality of localized low points, but will be described with reference to a single anode 30 for clarity, unless the context indicates otherwise.

Figure 3:
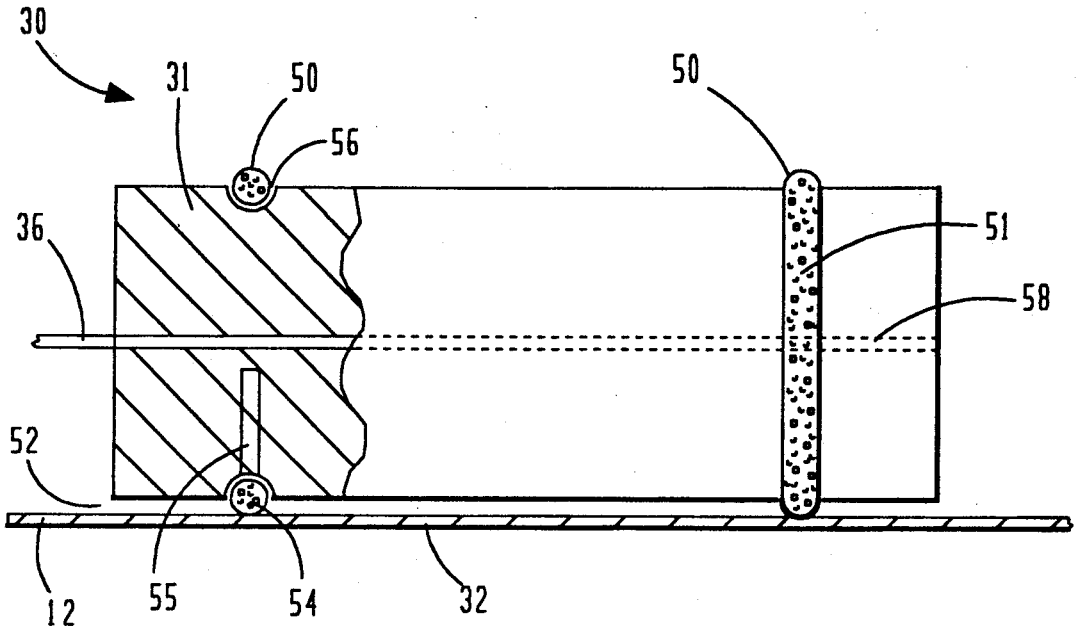
FIG. 3 is a partial cut-away side view of one embodiment of an anode according to the present invention.

With reference to FIG. 3, the special construction of anode 30, according to one embodiment of the invention, will be more fully understood. Anode 30 is provided with a spacer 50 which holds the metal portion 31 of anode 30 spaced above the internal bottom 32 of tank 12. The thickness of spacer 50 provides a small clearance distance 52 which is sufficient to avoid grounding of the metallic portion 31 of the anode 30 directly against the internal tank surface due to discontinuities as might be expected within the tank because of surface roughness or construction welds and the like.

It has been found that anodic protection occurs when an electrolyte solution contacts the tank and the metallic anode 30 simultaneously to make an electrolytic circuit between the anode and the tank surface. It has further been found that even small accumulations of moisture can form corrosive acidic or salt solutions when in contact with hydrocarbons. In dry climates and in a closed tank, the amount of accumulation may be small but destructive over a long time. Ordinarily, the corrosion will continue until the clearance distance 52 is bridged with a depth of the corrosive electrolyte 48. According to a preferred embodiment of Applicant's invention, the spacers 50 are constructed of a porous material, such as a porous ceramic material, which acts through capillary-type action as a wick to draw the water and electrolyte solution up toward and into contact with the metal portion 31 of anode 30. Preferably, spacer 50 comprises at least two spacers positioned toward either end of anode 30 to provide stability and so that tipping contact and short circuiting is not a problem.

Positioning the anodes at the lowest point of the tank is advantageously facilitated by constructing the anode with a rounded or cylindrical shape so that it will roll to the low spot in the tank. In the preferred embodiment shown in FIGS. 1 and 2, anode 30 is a cylindrically shaped anode in a cylindrically shaped tank 12, so that it may roll toward the bottom 32 of tank 12. In this manner, the lowest point in the tank or either end of the tank may be provided with anodic protection. Multiple additional anodes and connecting cables can be used in tanks having multiple potential low points.

Spacers 50 are advantageously formed as porous spacer rings 50 which can be conveniently held onto the anode through the formation of annular grooves 56. Porous spacer rings 50 allow the anode to roll while it is being installed. The rings 50 provide both spacing to avoid short circuiting and also provide a wicking action to produce electrolytic contact while it is in operation. The completed circuit or electrical connection from the anode to the tank is provided, as indicated before, with a connecting wire 36. Wire 36 may be a continuous length extending from the top connection 38 to the anode 30 at the tank bottom 32 where wire 36 is held inserted into a bore 58 of anode 30. The bore 58 may result by simply molding the anodic material 31 directly onto the connecting wire 36. Alternatively, a steel rod may be forced into a bore 58 and the connecting wire 36 electrically connected to the steel rod.

Figure 4:
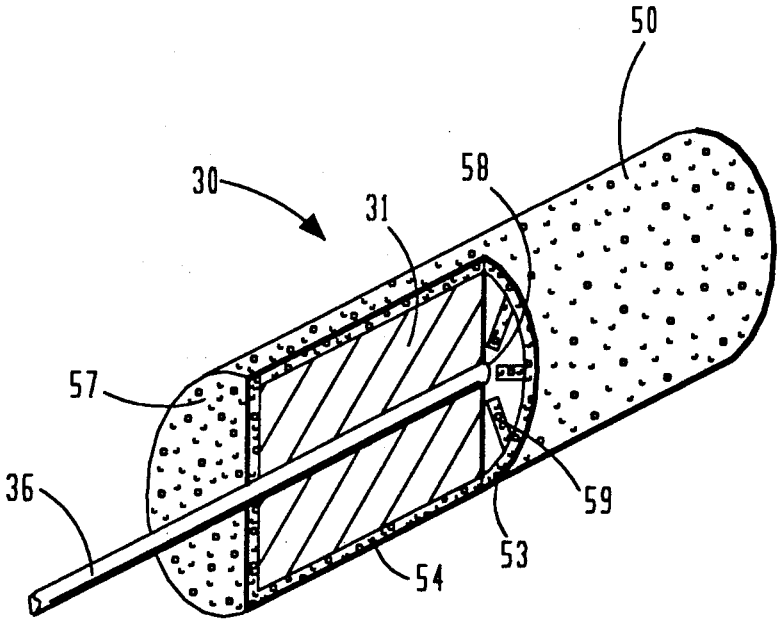
FIG. 4 is a partial cut-away side view of a porous ceramic encased anode according to the present invention.

A particular advantageous embodiment of an anode 30, according to the present invention, is depicted in a partial cut-away perspective view in FIG. 4. In this construction, the anode 30 comprises a metal anode portion 31 and a spacer means 50 which comprises a cylindrical sheath 53 and an end cap 57. Sheath 53 is preferably composed of a porous ceramic material or equivalent having multiple interstices of porosity 54 which extend from the surface of sheath 53 inward to the metal anode portion 31. The porous material acts as a wick so that even small amounts of electrolytic solution 48, if any, in the bottom of the tank is drawn upward to the metallic portion 31. It is noted that for most fuel storage tanks such as gasoline, the surface tension of water is sufficiently greater than that of the liquid hydrocarbon, such that the water wicks itself up into the porosity 54, thereby displacing the liquid hydrocarbon. To facilitate rapid protective action, where corrosive liquids are known to exist in a tank, the porous anodes can be soaked in water prior to installation.

As the anodic corrosion protection action takes place, the metal portion 31 will be consumed over a period of time. The positive ions move from the anode through the porosity 54 and the electrolyte 48 so that the steel tank does not deteriorate or corrode. As the metal portion 31 becomes partially consumed, the cylindrical shape of the sheath 53 and the flexibility of cable 36 permit the anode to roll to its lowest center of gravity, thereby facilitating the maintenance of the remaining portion of anode 31 in close proximity to the bottom of the tank 32. It is also found that as the anode deteriorates during the galvanic action, metal will disappear along the water contact. If the water is at least as deep as the diameter of the anode, there is no problem. However, if the water is very minor and only contacts the anode through the wick, the anode will begin to recede and no longer make contact with the electrolyte. A metal portion 31 totally encased within sheath 53 increases the surface area and therefore increases the time period of protection, usually sufficiently long for additional depth of liquid to build up in the tank. Spacers 50 or sheaths 53 interconnected with wicking extensions 55 and 59, respectively, may be constructed into the center of the anode to alleviate this concern.

It has been found advantageous to connect wire or cable 36 to the top of tank 12 as at upper bungholes 26 through a bunghole cap 40. This places the grounded connection above the liquid. Also advantageously, the activity of the anode can be conveniently monitored by connecting wire 36 to a test station 60 at the surface. Test station 60 may, for example, include a voltage detection circuit 62 which determines whether the desired voltage potential is present in the anode circuit. Approximately 0.8 volts has been found to be a desirable voltage potential which prevents destructive corrosion in steel tanks.

Figure 5:
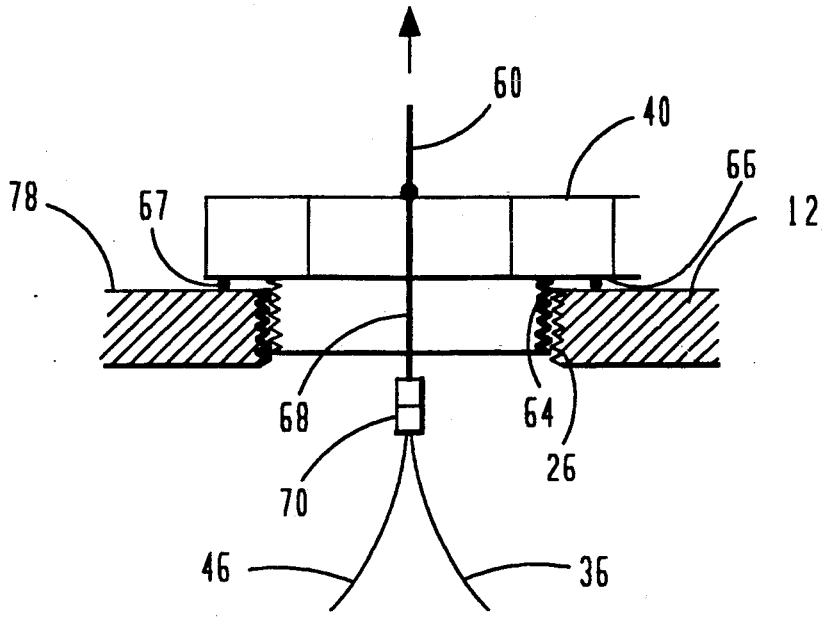
FIG. 5 is a front cross-sectional view of the bunghole cap and anode cable connector according to the present invention.

With reference to FIG. 5, the special construction of cap 40 is observed in which the bunghole cap 40 has external threads 64 corresponding to the internal threads of bunghole openings 26. A seal surface 66 is provided to interface with the top of the tank entirely around bunghole 26 to insure proper air-tight and liquid-tight sealing. A gasket 67 or an O-ring 67 may be interposed between seal surface 66 and the top of tank 12 to facilitate sealing. It will be noted that the electrical connection is directly through thread 64 so that insulation at sealing surface 66 does not interfere with the operation of the anode protection device. A bore 68 is provided through cap 40 so that connector cable 36 may extend out of the top. The length of the wire cable 36 is more than the diameter of a cylindrical storage tank 12, in order to reach the bottom of the tank and preferably is sufficiently long to reach either end of the tank. The cable may have sufficient flexibility to allow bunghole cap 40 to be threaded and tightened by rotating it several times without transmitting a significant amount of torsional force to the anodes. The anodes roll to the low spot and remain in their place at the lowest point in the tank. Preferably, in order to insure that the twisting of cap 40 into a closed position does not adversely affect the positioning of anodes 30 at the bottom 32 of tank 12, a swivel connector 70 is advantageously attached between cable 36 and cap 40. Swivel connector 70 is also useful in the event that multiple sets of anodes and multiple cables 36 and 46 are to be connected to a single bunghole cap. It will be noted that a single cap 40 is desirable even where multiple anodes are used so that a single test station 60 can determine whether the anode is, in fact, properly operating. Alternatively, separate connections may be made for cable 36 and for cable 46. In that event, separate test stations 60 may be connected so that it can be determined that at least one of the anodes is providing the desired electrical potential. It may also be determined which anodes are actually operating in an electrolyte solution to generate an electrical current. The replacement schedule can also be more accurately predicted. Removing the anodes and inspecting them might be avoided. The anodes which are deteriorating are obviously the ones actively in the electrolyte providing the internal anti-corrosion protection. The anodes are consumed over a period of time so that the tank does not deteriorate. The time period depends upon the total size of the anodes and the electrical activity.

Figure 6:
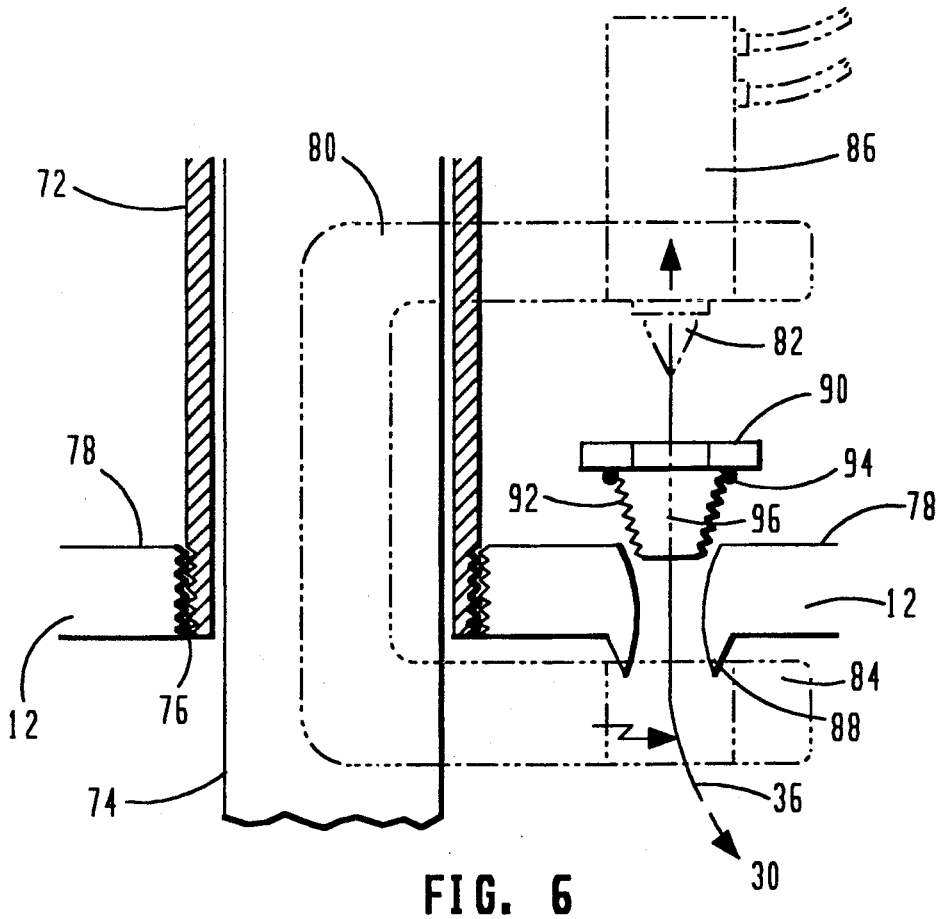
FIG. 6 is a partial cross-sectional view of a portion of a storage tank and fill tube depicting in phantom lines an apparatus and method for producing a punched access hole for insertion of an anode and wire cable connector according to the present invention.

FIG. 6 is a partial cross-sectional view of the fill tube and top of tank 12 adjacent to the fill tube with a mechanism (depicted in phantom lines) for producing hole 88. In the event that an existing bunghole or other opening is not available for insertion and/or grounding of the anodes, a separate opening 88 may be formed as shown according to this feature of the present invention. Substantially all modern underground gasoline or fuel oil storage tanks have basting openings 76 which are occupied with a removable device 72, such as a pump, a level gauge, a vent, or a fill tube 72. The anodes may be inserted through the opening 76 and grounded at a small separate opening 88. Opening 88 could also be formed large enough to insert anodes and/or remove and reinsert anodes directly through opening 88.

Typically, the fill tube 72 acts as a guide for a drop tube 74 which is a lightweight aluminum tube which extends close to the bottom of tank 12, so that filling of tank 12 is done with minimum creation of turbulence in the stored liquid fuel. In order to create an additional access hole 88 for grounding and/or insertion of anode protection device 10, the drop tube and fill tube are unthreaded from access hole 76. Then a removable punch C-frame 80 (depicted in phantom lines) is inserted and positioned to one side of the access hole 76 as indicated so that a punch ram 82 is above the tank top 78 and a support anvil 84 is adjacent to the interior of tank top 78. Punch ram 82 is driven with a mechanism, and preferably a hydraulic cylinder 86, so that changes of sparks are avoided. Alternatively, for example, a threaded ram (not shown) might be used at slow speeds to avoid potential frictional hot spots. The punch ram 82 has a sharp point which pierces the top 78 of tank 12 to create a punched hole 88. The anodes and wire cables are inserted through hole 88 and wire 36 is connected to a special cap 90 which functions similar to a bunghole cap 40 according to the invention. Cap 90 is provided with attachment means, such as self-tapping threads 92 sized corresponding to punched hole 88. A seal 94, such as an O-ring 94, insures that an air-tight and liquid-tight capping is accomplished. Special self-threading cap 90 has a wire connection 96 similar to the wire connection 38 of the corresponding bunghole cap 40. The punch C-frame 80 is removed and the fill tube assembly 20, including drop tube 74 and guide tube 72, are rethreaded into fill opening 76, to rapidly retrofit the storage tank 12 with internal anode protection without removing it from service.

Other alterations and modifications of the invention will likewise become apparent to those of ordinary skill in the art upon reading the present disclosure. The invention is not intended to be limited to the particular embodiments disclosed; but, rather, it is intended that the scope of the invention disclosed herein be limited only by the broadest interpretation of the appended claims to which the inventors are legally entitled.

What is claimed is:

1. An internal corrosion prevention anode device for insertion into a liquid holding storage tank of the type formed of steel and having a closed top and having a bottom with one or more low points into which an electrolytic solution will collect, said anode device comprising:

(a) an opening into said closed top of said storage tank;

(b) an anode sized for insertion through said opening and having a rounded cross-sectional shape so that said anode rolls toward to the low point in said storage tank;

(c) an elongated electrical conductor attached to said anode, having a sufficient length for extending from said top to said bottom of said tank and having sufficient flexibility along said length to permit said anode to roll to one of said one or more low points in said tank; and (d) a cap sized for closing said opening and constructed for electrically connecting said elongated electrical conductor to said top of said storage tank to complete an electrical circuit from said anode at said bottom to said top of said tank.

2. An internal corrosion prevention anode device as in claim 1 further comprises:

(a) a metallic interior portion of said anode; and (b) spacer means having a rounded cross-sectional shape affixed around said metallic interior portion, such that metal-to-metal contact between said tank and said metal portion of said anode is prevented, and such that said anode is permitted to roll to said one low point of said tank.

3. An internal corrosion prevention anode device as in claim 2 wherein said rounded shaped spacer means is composed of a porous electrically insulative material such that it provides a wick-like action to draw electrolyte from said low point in said tank into contact between said tank and said metallic portion of said anode.

4. An internal corrosion prevention anode device as in claim 3 wherein said rounded shaped spacer means comprises a pair of spaced apart rings.

5. An internal corrosion prevention anode device as in claim 3 wherein said spacer means comprises a cylindrical casing of said porous electrically insulative material.

6. An internal corrosion prevention anode device as in claim 4 wherein said porous electrically insulative material is composed of a porous ceramic material.

7. An internal corrosion prevention anode device as in claim 5 wherein said porous electrically insulative material is composed of a porous ceramic material.

8. An internal corrosion prevention anode device as in claim 1 wherein said tank has a horizontal cylindrical shape with more than one relative low point along said bottom of said tank, and said anode device further comprises:

(a) a cylindrical shaped metallic portion of said anode, such that it has a rounded cross-sectional shape perpendicular to a central axis of said cylindrical shaped metal portion; and (b) spacer means including a ring of electrically insulative material affixed around said cylindrical metallic portion so that said anode is permitted to roll on said ring and so that direct metal-to-metal contact between said metallic portion of said anode and said steel tank is prevented.

9. An internal corrosion prevention anode device as in claim 8 wherein:

(a) said elongated electrical connector is attached at said central axis of said cylindrical shaped metallic portion of said anode so that rolling is facilitated and so that said elongated electrical conductor is continuously spaced apart from said tank bottom.

10. An internal corrosion prevention anode device as in claim 8 wherein said insulative ring is composed of a porous electrically insulative material such that it provides a wick-like action to draw electrolyte from said low point in said tank into contact between said tank and said metallic portion of said anode.

11. An internal corrosion prevention anode device as in claim 10 wherein said ring of porous material further comprises porous wicking extensions radially projecting into said metallic portion of said anode.

12. An internal corrosion prevention anode device as in claim 10 wherein said ring of porous material is composed of a porous ceramic material.

13. An internal corrosion prevention anode device as in claim 10 wherein said ring of porous electrically insulative material further comprises a continuous ring forming a cylindrical shaped casing entirely enclosing said cylindrical shaped metallic anode portion.

14. An internal corrosion prevention anode device as in claim 13 wherein said cylindrical shaped casing of porous electrically insulative material is composed of a porous ceramic material.

15. An internal corrosion prevention anode device as in claim 13 wherein said cylindrical shaped casing further comprises porous wicking extensions radially projecting into said metallic portion of said anode.

16. An internal corrosion prevention anode device as in claim 1 wherein said anode having a rounded cross-sectional shape comprises:

(a) a metallic anode portion; and (b) a porous ceramic casing having a rounded exterior shape and substantially enclosing said metallic anode portion, such that electrolytic solution collected in said low points is drawn through said porous casing material to provide an anodic corrosion prevention circuit between said steel tank and said metallic anode portion.

17. An internal corrosion prevention anode device as in claim 1 wherein said elongated electrical conductor is attached through a swivel connector at said cap, such that rotation of said cap is permitted by said swivel connector without placing torsional force through said elongated electrical conductor and to said rounded anode.

18. An internal corrosion prevention anode device as in claim 1 wherein said tank has a horizontal cylindrical shape and said elongated connector has one end to which said anode is connected and another end connected to said cap, and further comprising multiple cylindrical shaped anodes connected in spaced apart series at said one end of said elongated electrical conductor, such that said series of spaced apart cylindrical anodes are coaxially positioned on said elongated electrical conductor and may roll to said low point in said cylindrical shaped storage tank.

19. An internal corrosion prevention anode device as in claim 1 wherein said tank has a horizontal cylindrical shape with separated ends, and further comprising multiple cylindrical shaped anodes attached to multiple elongated conductors inserted through a single opening into said tank and directed to said separated ends of said storage tank, so that each of said multiple cylindrical shaped anodes may roll to a low point in said separated ends of said tank.

* * * * *